US007207627B2

(12) United States Patent
Jerome

(10) Patent No.: US 7,207,627 B2
(45) Date of Patent: Apr. 24, 2007

(54) SEAT CUSHION WITH GRIPPING MEMBER

(75) Inventor: Peter A. Jerome, Tiverton, RI (US)

(73) Assignee: New Harbour, Inc., Fall River, MA (US)

( * ) Notice: Subject to any disclaimer, the term of this patent is extended or adjusted under 35 U.S.C. 154(b) by 120 days.

(21) Appl. No.: 10/753,803

(22) Filed: Jan. 7, 2004

(65) Prior Publication Data

US 2005/0146177 A1 Jul. 7, 2005

(51) Int. Cl.
*A47C 31/00* (2006.01)

(52) U.S. Cl. ..... 297/219.1; 297/DIG. 6

(58) Field of Classification Search ..... 297/DIG. 6, 297/219.1, 228.12, 228.13, 397, 284.5
See application file for complete search history.

(56) References Cited

U.S. PATENT DOCUMENTS 3,220,767 A * 11/1965 Hendrickson ..... 297/228.12
4,190,918 A * 3/1980 Harvell ..... 5/653
4,457,032 A 7/1984 Clarke ..... 5/481
5,346,278 A * 9/1994 Dehondt ..... 297/219.1
5,429,852 A 7/1995 Quinn ..... 428/71
D360,794 S 8/1995 Morin ..... D6/601
5,465,441 A * 11/1995 Chun ..... 5/653
5,475,886 A 12/1995 Mintz ..... 5/653
5,557,815 A 9/1996 Mintz et al. ..... 5/636
5,809,595 A * 9/1998 Stevens et al. ..... 5/653
5,896,603 A 4/1999 Cooper ..... 5/653
5,906,878 A * 5/1999 Horning et al. ..... 428/131
6,022,617 A * 2/2000 Calkins ..... 428/354
6,058,535 A * 5/2000 Firkins et al. ..... 5/653
6,212,717 B1 4/2001 Cooper ..... 5/653
6,578,914 B2 * 6/2003 Artsvelyan ..... 297/219.1

* cited by examiner

*Primary Examiner*—Milton Nelson, Jr.
(74) *Attorney, Agent, or Firm*—Sheridan Ross P.C.

(57) ABSTRACT

A seat cushion is provided including an integral gripping member that prevents the cushion from sliding during use. The gripping member attaches to the cushion by a connecting strap which therefore allows the gripping member to be selectively placed in contact with either panel of the cushion. Accordingly, either one of the panels may be exposed during use which allows the seat cushion to be constructed of differing materials, colors or patterns for the respective panels. Additionally, damage to one of the panels still allows the gripping member to be used because the cushion can be reversed to expose the non-damaged panel.

14 Claims, 4 Drawing Sheets

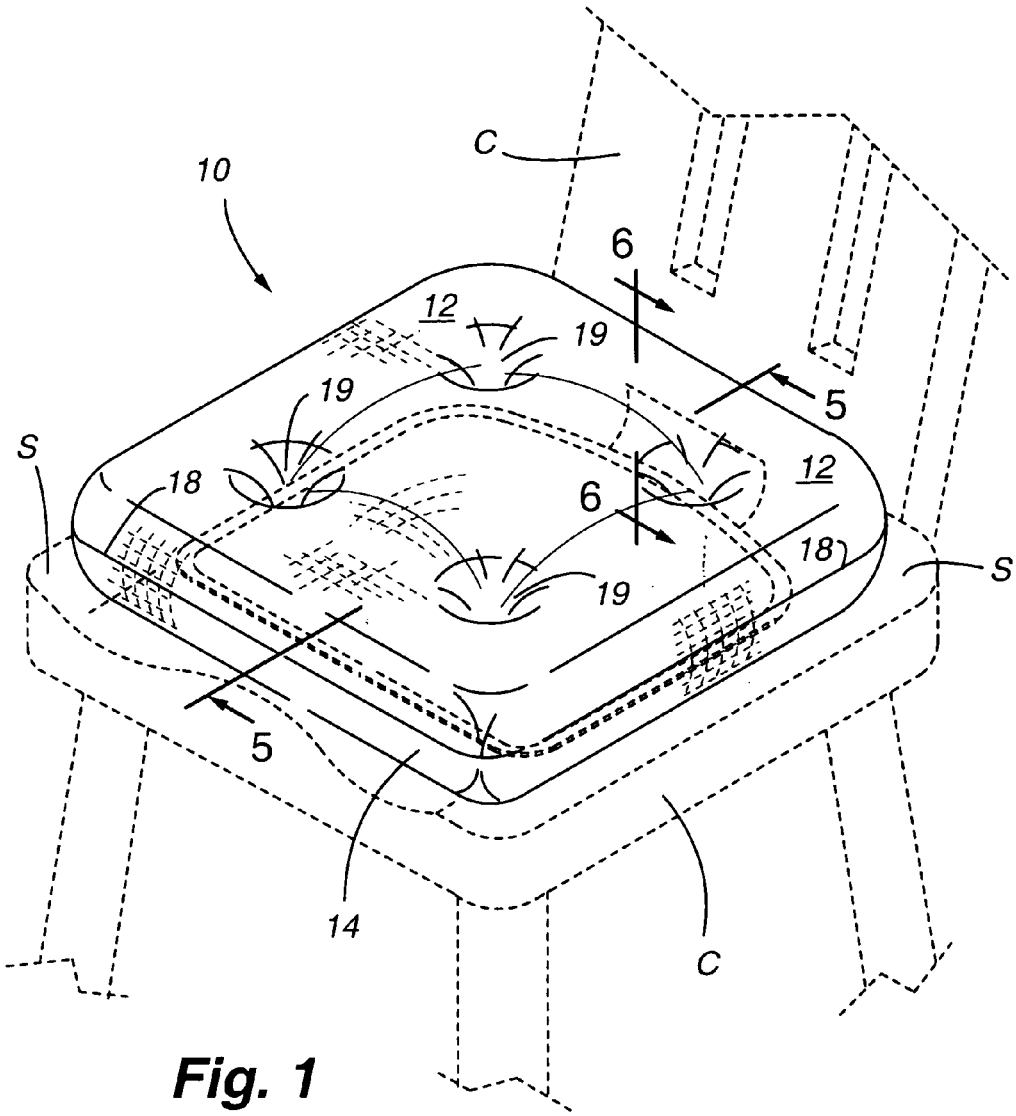
Fig. 1
Fig. 2
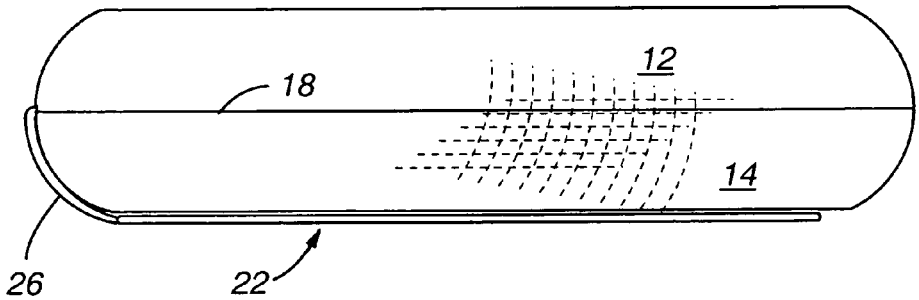

SEAT CUSHION WITH GRIPPING MEMBER

FIELD OF THE INVENTION

The present invention relates to household articles with non-slip or gripping surfaces, and more particularly, to cushions particularly adapted for chairs or stools that include a gripping member to prevent the cushion from sliding or slipping.

BACKGROUND OF THE INVENTION

Many household articles are placed over smooth surfaces and the articles will undesirably slip or slide over the surfaces when in use. Decorative pillows and cushions are examples of articles that may be placed over a smooth surface and are intended to remain in their position during use. For chair or stool cushions, one manner in which to prevent the cushions from sliding is to provide string ties that attach the cushions to the chairs or stools. An alternative solution to string ties is the use of material having a high coefficient of friction that prevents the cushions from sliding.

The U.S. Pat. Nos. 6,212,717 and 5,896,603 disclose chair cushions and place mats formed of a top fabric panel attached to a bottom panel that has a high coefficient of friction. The bottom panel is preferably a rubberized web material with an open or mesh pattern. The rubberized material prevents the chair cushion or place mat from sliding over smooth surfaces. U.S. Pat. No. 4,457,032 discloses a cushion having a lower layer that also has a high coefficient of friction. U.S. Pat. No. 5,429,852 shows another chair pad or cushion also having a lower panel with a high coefficient of friction. The U.S. Design Pat. No. 360,794 illustrates a combined child cushion and rubber grip pad unit.

While these inventions may be adequate for their intended purposes, there is still a need for an improved chair cushion with integral gripping surfaces or elements. One particular disadvantage of those chair cushions which permanently attach the gripping surface is that the chair cushion has only one side that can be exposed during use. Chair cushions often become stained or otherwise damaged during use. Therefore, if the exposed side becomes irreparably damaged or stained, then it may require replacement because the cushion cannot be reversed. Also, the amount of surface area for gripping remains constant with a gripping surface that is sewn or otherwise permanently attached to the chair cushion. In some circumstances, it may be desirable to have at least some ability to slide or move the chair cushion during use because a gripping surface which completely immobilizes a chair cushion during use may pose discomfort for the user.

In accordance with the present invention, these disadvantages are overcome, and other benefits and advantages of the invention are provided.

SUMMARY OF THE INVENTION

In accordance with the present invention, a seat cushion is provided with a gripping member. The seat cushion of the present invention includes upper and lower panels with padding or fill material placed between the upper and lower panels. Preferably, the panels are made of cloth. The fill material may be a resilient material, such as foam, thereby enabling the cushion to not only provide padding for a user, but will also return to its undeformed shape when not in use. The gripping member is attached as by a connecting strap which may be in the form of a desired length and width of cloth material that matches the material used for the upper and lower panels. The gripping member may be in the form of rubberized web material with a desired mesh pattern that is commercially available in sheet form. This type of web material may be used for a variety of different applications including non-slip padding for rugs and carpets, among other uses. The rubberized web material has an irregular surface texture which adds to the ability of the material to create a very high coefficient of friction when placed in contact with a surface. The size of the gripping member is sized to either substantially match the shape of the upper and lower panels, or may be otherwise sized to provide the desired amount of gripping surface to prevent the cushion from slipping during use. Because the gripping member is not sewn or otherwise attached directly to other the upper or lower panel, the gripping element may be placed in contact with either the upper or lower panel in use. Accordingly, the effective life of the seat cushion can be increased. The gripping member can be rotated to a position so that it contacts the desired panel during use. More specifically, the gripping member would be rotated so that it was placed under the damaged panel, and the non-damaged panel would be exposed during use.

Additionally, the present invention also accommodates a seat cushion that may have panels of differing types of cloth patterns, textures or colors. Accordingly, the seat cushion is reversible yet the gripping member can be used with either panel being exposed. For example, depending upon the particular decor of the room in which the seat cushion was used, it may desirable to change the exposed surface of the seat cushion by exposing the panel with the best pattern, color or texture.

These features and advantages of the present invention are set forth in more specificity in the following drawings taken in conjunction with the detailed description.

BRIEF DESCRIPTION OF THE DRAWINGS

FIG. 1 is a perspective view of the seat cushion of the present invention installed on a chair;

FIG. 2 is an elevation or side view of the seat cushion of the present invention;

DETAILED DESCRIPTION

Figure 3:
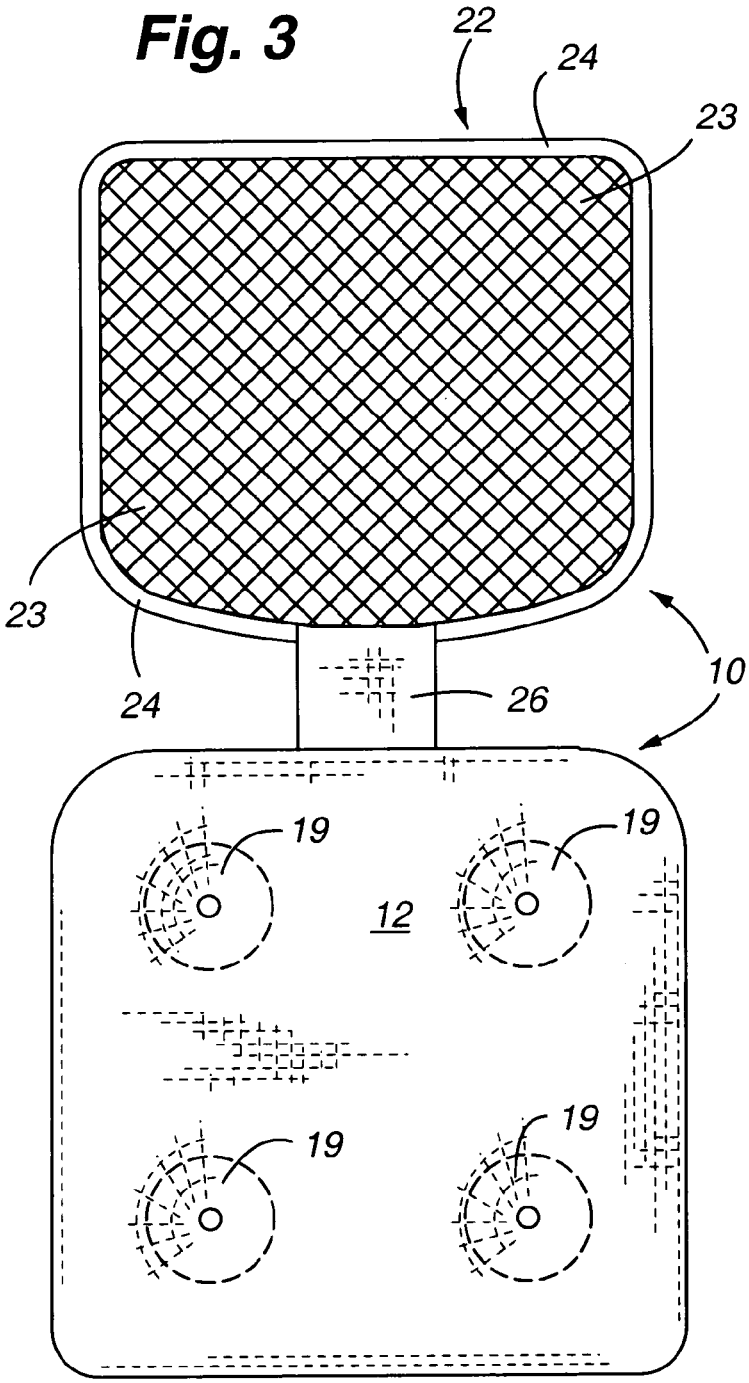
FIG. 3 is a plan view illustrating the seat cushion with the gripping member rotated away from the upper and lower panels.
Figure 4:
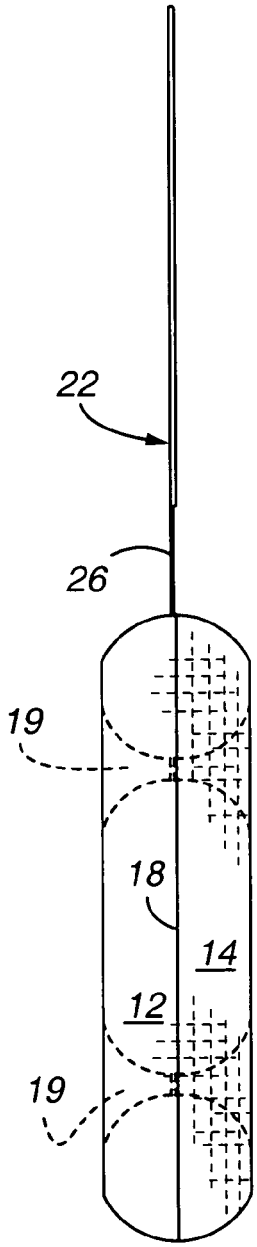
FIG. 4 is another elevation or side view illustrating the gripping member rotated away from the panels.
Figure 5:
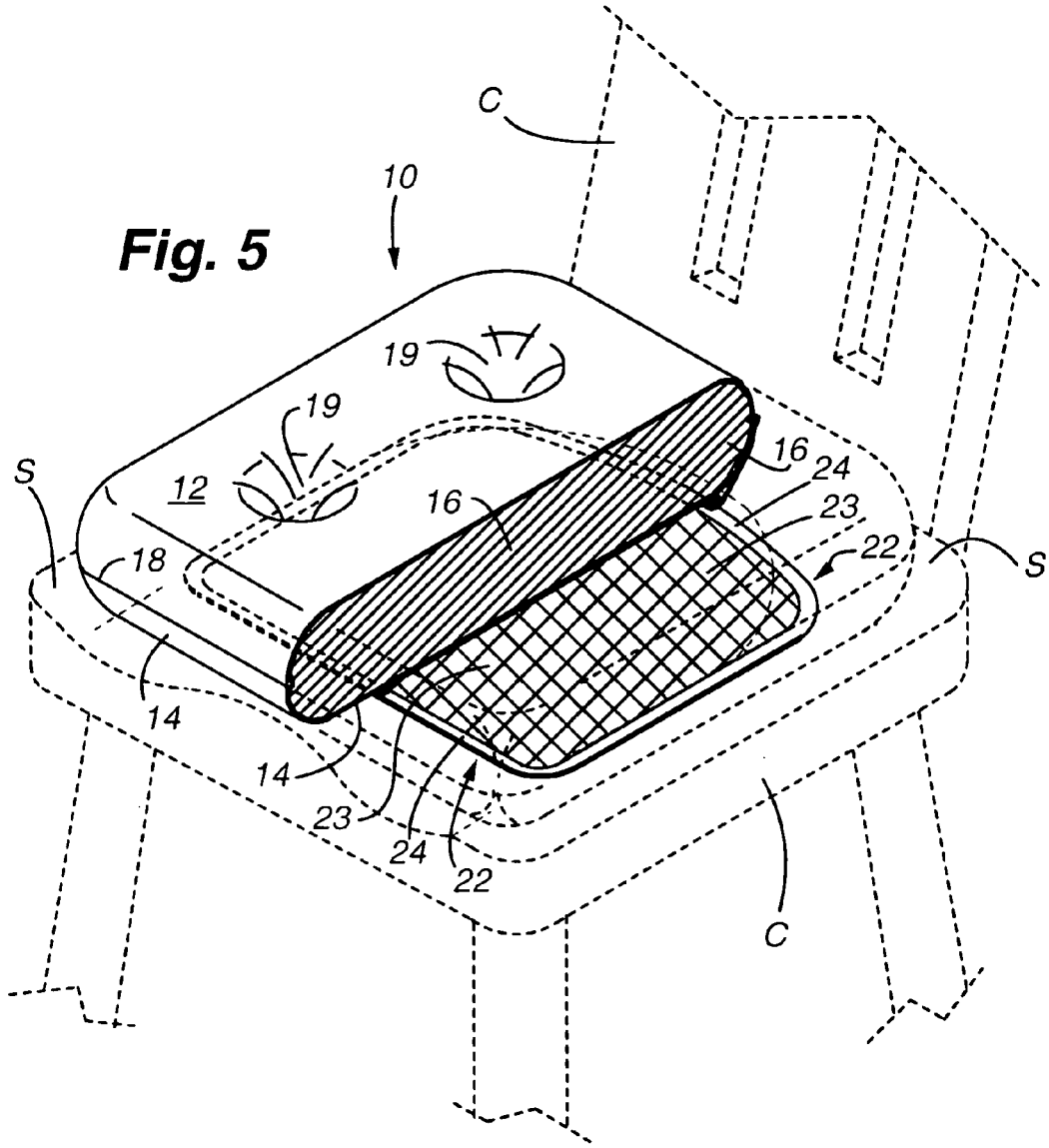
FIG. 5 is a fragmentary perspective view taken along line 5—5 of FIG. 1 illustrating the seat cushion and the positioning of the gripping member during use.
Figure 6:
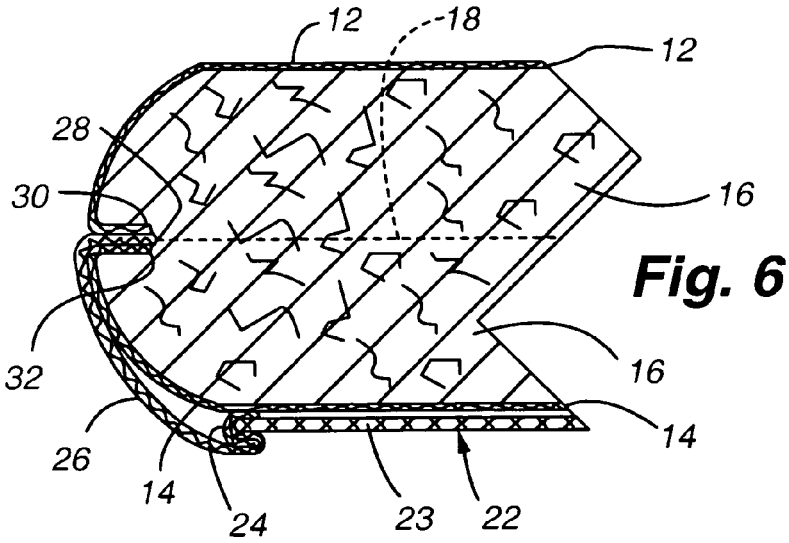
FIG. 6 is an enlarged fragmentary section taken along line 6—6 of FIG. 1 illustrating details of the invention to include the manner in which the gripping member is attached to the panels.

Referring to the figures, a seat or chair cushion 10 is illustrated as it may be used with a standard chair C. As shown in FIGS. 1 and 5, the gripping member 22 is placed between a lower panel 14 of the cushion and the surface S of the chair. The cushion 10 includes both an upper panel 12 and the lower panel 14. In use, these panels may be reversed such that the lower panel 14 is exposed and the upper panel 12 is under the lower panel 14 and in contact with the gripping member 22. Resilient padding or fill material 16 is placed between the upper and lower panels, and appropriate stitching 18 interconnects the panels. The cushion may be of a desired design to include tufts or other surface features. In the embodiment shown in the figures, tufts 19 are provided as both functional and aesthetic features of the chair cushion. The gripping member 22 is attached to the cushion as by a strap 26. The strap 26 may match the same fabric or material used for the panels. The strap may be a single layer of material or be of a doubly reinforced construction. The gripping member 22 may include a peripheral edge or rim 24 that is made of the same material as the panels and the strap. The edge or rim 24 provides a reinforced edge for the gripping material 23 thereby preventing fraying or deterioration of the edges of the gripping material 23. Referring specifically to FIG. 6, one manner in which the gripping member 22 may be incorporated with the cushion of the present invention is to attach strap 26 to the edge 24 as by sewing the strap within the edge. As shown, the strap 26 has an end 28 that is sandwiched between respective panel ends 30 and 32, and then the three layered structure is sewn together. As best seen in FIG. 2, the length of the strap 26 allows the strap to extend such that the gripping member may be placed flush against either the upper or lower panel. The gripping member may simply be rotated between the upper and lower panels thereby allowing a user to decide which panel should be exposed during use.

Figure 7:
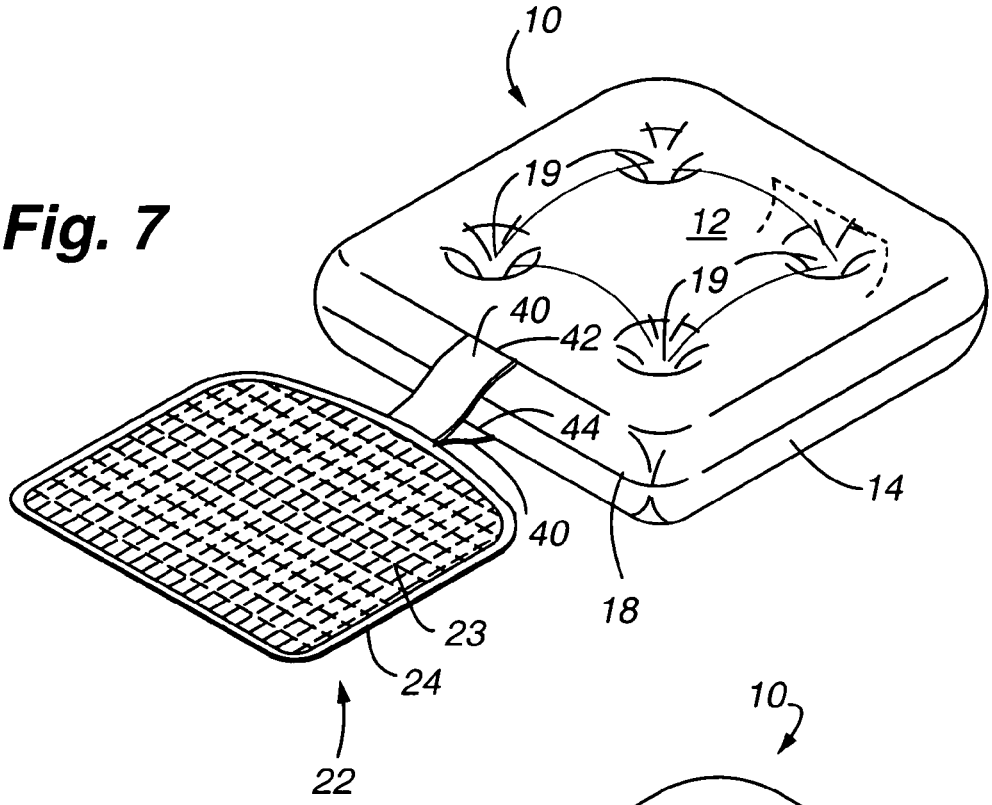
FIG. 7 is a perspective view of the seat cushion of the present invention illustrating an alternate way in which to attach the gripping member to the cushion.

FIG. 7 illustrates an alternative way in which to attach the gripping member 22 to the cushion. In lieu of a single strap, a pair of straps 40 may be used that attach to the panels 12 and 14 as shown. Preferably, one of the straps 40 attaches along an upper surface of the panel 12 along stitch line 42, while the other strap 40 attaches along a lower surface of panel 14 along stitch line 44. Straps 40 are long enough so that when a gripping member is rotated to contact either the upper or lower panels, the gripping member may be centered over the panels.

Figure 8:
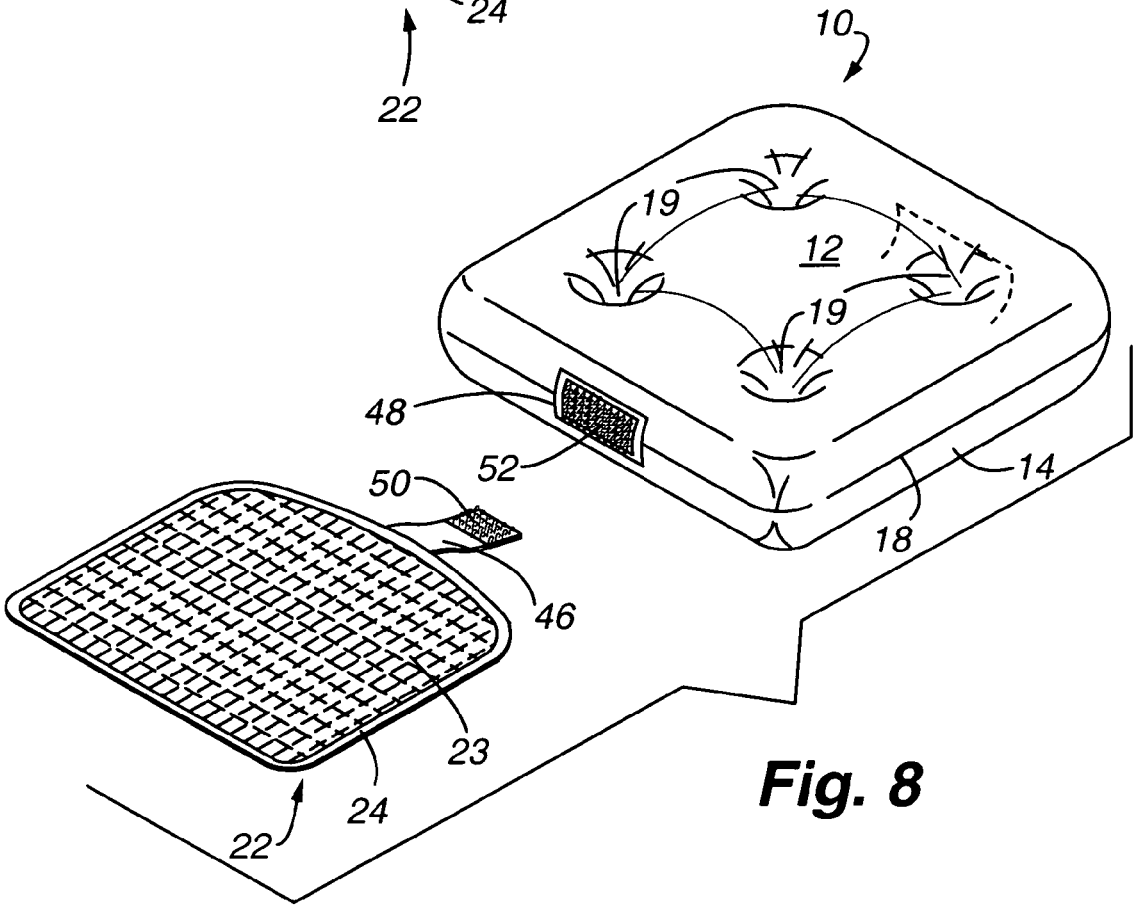
FIG. 8 is yet another perspective view of the seat cushion of the present invention illustrating yet another way in which to attach the gripping member to the cushion.

FIG. 8 shows yet another alternative way in which the gripping member 22 may be attached to the cushion. In this alternative arrangement, hook and pile material is used. More specifically, a strap 46 attaches to the edge 24 of the gripping member 22, and at least some portion of the strap 46 has a tab made of hook or pile material 50 attached thereto. A strip of cloth material 48 is attached to the panels 12 and 14 as shown, preferably along stitching 18. Then, a tub of hook or pile material 52 is attached over the cloth strip 48. Tabs 50 and 52 when placed together secure the gripping member to the cushion. Thus, in the arrangement shown in FIG. 8, the gripping member 22 is selectively detachable.

As seen in the figures, the shape of the gripping member 22 is substantially rectangular thereby matching the shape of the upper and lower panels. However, the shape and size of the gripping member may be changed to accommodate both the particular design or shape of the panels of the cushion, as well as to provide the desired amount of gripping surface area. For a chair or stool having particularly slippery or smooth surfaces, it is desirable to maximize the size of the gripping member in order to prevent the cushion from sliding. However, if the surface of the chair or stool is not as slippery, then the gripping member may be reduced in size. Depending upon the type of material chosen for the panels and the amount of padding used, it may be desirable to not completely immobilize the cushion during use. Particularly when a style of cushion chosen has substantial padding, some ability to slide or slip may be desirable over complete cushion immoblization because the cushion itself may bunch or fold under the pressure of the user thereby creating some discomfort.

The advantages of the present invention are clear. If either one of the upper or lower panels becomes damaged, the gripping member may be selectively placed against the damaged panel in use so that the remaining non-damaged panel is exposed. Alternatively, the upper and lower panels may be made of differing materials to include color, texture, or patterns, and the gripping member therefore has functionality in terms of its ability to provide high friction resistance regardless of which panel is chosen to be exposed.

While the present invention has been described and illustrated with respect to a preferred embodiment, it shall be understood that various other changes or modifications may be made within the spirit and scope of the present invention.

What is claimed is:

1. A seat cushion for placement on a seat of a piece of furniture comprising:

a first flexible cloth panel;

a second flexible cloth panel;

fill material placed between said first and second panels, said first and second panels being joined to one another;

a gripping member having a shape substantially conforming to a shape of said first and second panels; and a strap interconnecting said gripping member to at least one of said first and second panels; and wherein said gripping member is rotated to be placed between the seat and in contact with one of said panels when said seat cushion is placed on the seat.

2. A cushion, as claimed in claim 1, wherein:

said gripping member is made of a rubberized web material.

3. A cushion, as claimed in claim 1, further including:

a cloth edge formed about a periphery of said gripping member.

4. A cushion, as claimed in claim 1, wherein:

said strap and at least one of said first and second panels includes hook and pile material enabling said gripping member to be removably attached to said panels.

5. A cushion, as claimed in claim 1, wherein:

said strap is flexible so that said gripping member may be rotated to be placed in contact with either said first or second panel.

6. A cushion, as claimed in claim 1, wherein:

said first panel is made of a first cloth material, and said second panel is made of a second different cloth material.

7. A cushion, as claimed in claim 1, wherein:

said first panel is made of cloth having a first pattern and said second panel is made of cloth having a second different pattern.

8. A cushion, as claimed in claim 1, wherein:

said first panel has a first color, and said second panel has a second different color.

9. A cushion, as claimed in claim 1, wherein:

said strap includes a piece of cloth material connected to at least one of said first and second panels along a stitch line interconnecting the first and second panels.

10. A cushion, as claimed in claim 1, wherein:

said strap includes a pair of straps interconnecting said gripping member to both said first and second panels.

11. A seat cushion for placement on a seat of a piece of furniture comprising;

a first flexible cloth panel;

a second flexible cloth panel;

fill material placed between said first and second panels, said first and second panels being joined to one another;

means selectively contacting said first and second panels for providing a high coefficient of friction to prevent slippage of said first or second panel when placed in contact with a surface of a chair or stool, said means for contacting having a shape substantially corresponding to a shape of said first and second cloth panels;

wherein said means for contacting is selectively rotated to be placed between and in contact with only one of said panels, and not both of said panels, when said seat cushion is placed on the seat; and a flexible strap connected to said means for contacting so that said means for contacting may be rotated to be placed in contact with either said first or second panel.

12. A cushion, as claimed in claim 11, wherein:

said means for contacting is made of a rubberized web material.

13. A seat cushion, as claimed in claim 11, further including:

a cloth edge formed about a periphery of said means for contacting.

14. A method of providing cushioning for a chair or stool, said method comprising the steps of:

providing a seat cushion including an upper panel, a lower panel, and padding placed between said upper and lower panels;

providing a gripping member attached to the panels by a flexible strap;

choosing a panel to be exposed during use;

rotating the gripping member to contact the panel not to be exposed during use; and placing the cushion on the chair or stool so that the gripping member remains in contact with the panel not to be exposed so that the gripping member contacts a surface of the chair or stool.

* * * * *